US010335819B2

(12) United States Patent
Gardner et al.

(10) Patent No.: US 10,335,819 B2
(45) Date of Patent: Jul. 2, 2019

(54) VISUAL PERFORMANCE INFORMATION OF AN EJECTION DEVICE

(71) Applicant: HEWLETT-PACKARD DEVELOPMENT COMPANY, L.P., Houston, TX (US)

(72) Inventors: James Michael Gardner, Corvallis, OR (US); Eric T Martin, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/329,516

(22) PCT Filed: Jul. 31, 2014

(86) PCT No.: PCT/US2014/049104
§ 371 (c)(1),
(2) Date: Jan. 26, 2017

(87) PCT Pub. No.: WO2016/018353
PCT Pub. Date: Feb. 4, 2016

(65) Prior Publication Data

US 2017/0209884 A1 Jul. 27, 2017

(51) Int. Cl.
*B05B 12/08* (2006.01)
*B41J 2/045* (2006.01)
*B41J 2/175* (2006.01)

(52) U.S. Cl.
CPC ..... *B05B 12/082* (2013.01); *B41J 2/04536* (2013.01); *B41J 2/04541* (2013.01); *B41J 2/04586* (2013.01); *B41J 2/1753* (2013.01); *B41J 2/17553* (2013.01)

(58) Field of Classification Search
CPC ..... B41J 29/393; B41J 2002/17569; B05B 12/08; B05B 12/082
See application file for complete search history.

(56) References Cited

U.S. PATENT DOCUMENTS 3,480,901 A * 11/1969 Jacks ..... H01H 85/303 337/244
5,691,750 A * 11/1997 Edwards ..... B41J 2/17566 347/19
8,025,573 B2 9/2011 Stenton et al.
(Continued)

FOREIGN PATENT DOCUMENTS

CN 101879817 A 11/2010

OTHER PUBLICATIONS

A Built-in Self-Test Method for Write-only Content Addressable Memories/Dilip K. Bhavsar, Intel Corp.
(Continued)

*Primary Examiner* — Sharon A. Polk
(74) *Attorney, Agent, or Firm* — HP Inc. Patent Department

(57) ABSTRACT

Examples of an apparatus and method are disclosed herein. In an example of the method, the performance of an ejection device that dispenses a composition is measured, information representative of the measured performance of the ejection device is generated, and the information representative of the measured performance of the ejection device is recorded so that the information is visually perceptible.

20 Claims, 4 Drawing Sheets

(56) References Cited

U.S. PATENT DOCUMENTS

| | | | | |
|---|---|---|---|---|
| 2003/0117467 | A1* | 6/2003 | Jung | B41J 2/17513 347/86 |
| 2005/0025390 | A1 | 2/2005 | Tsujii | |
| 2005/0146549 | A1* | 7/2005 | Koyama | B41J 29/393 347/19 |
| 2009/0141293 | A1 | 6/2009 | Fujimoto | |
| 2010/0182390 | A1 | 7/2010 | Imaizumi | |
| 2011/0187771 | A1 | 8/2011 | Helterline et al. | |
| 2012/0023027 | A1 | 1/2012 | Sundquist et al. | |
| 2012/0075371 | A1 | 3/2012 | Baumgartner | |
| 2014/0009768 | A1 | 1/2014 | Hegarty et al. | |
| 2015/0041555 | A1* | 2/2015 | Ahmadi | B05C 5/0216 239/71 |
| 2015/0290932 | A1* | 10/2015 | Anderson | B41J 2/17546 347/9 |
| 2017/0106646 | A1* | 4/2017 | Anderson | B41J 2/0451 |

OTHER PUBLICATIONS

Inkjet Printing of Non-Volatile Rewritable Memory Arrays. Voit, et al. Thin Film Electronics AB (TFE). Linkoping Sweden.

Korean Intellectual Property Office, International Search Report and Written Opinion for PCT/US2014/049104 dated Apr. 21, 2015 (15 pages).

* cited by examiner

VISUAL PERFORMANCE INFORMATION OF AN EJECTION DEVICE

BACKGROUND

Some devices or processes may utilize replaceable components or sub-assemblies. Some of these replaceable components or sub-assemblies may be covered by warranty or other type of guarantee in the event of premature failure or inadvertent damage. Designers, manufacturers, distributors and/or suppliers of these replaceable components or sub-assemblies may, therefore, be interested in information concerning sage of such components or sub-assemblies as it pertains to any warranty or other guarantee they provide.

BRIEF DESCRIPTION OF THE DRAWINGS

The following detailed description references the drawings, wherein.

DETAILED DESCRIPTION

Figure 1:
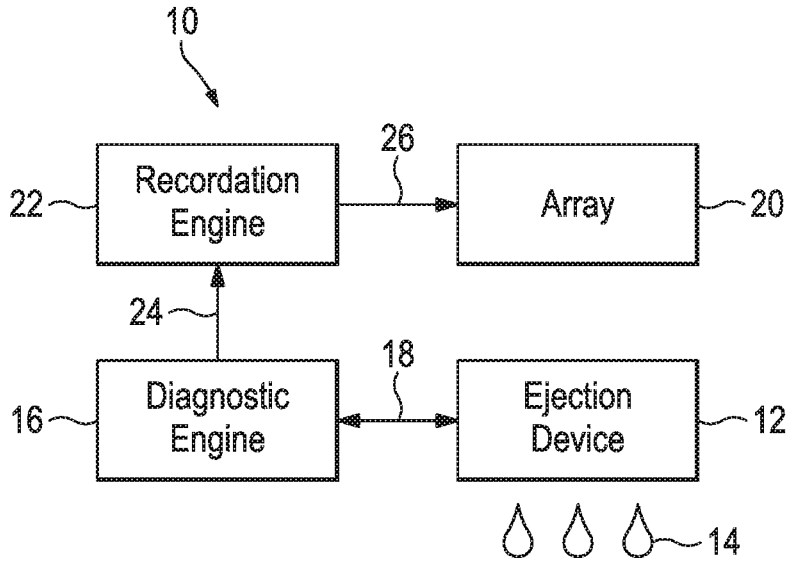
FIG. 1 is an example of an apparatus.

Diagnostic information concerning performance of an ejection device may be stored in non-volatile memory for subsequent retrieval. Such retrieval, however, requires electrical functionality of the communication channels through which such diagnostic information is retrieved. If these communication channels are rendered inoperable, then this diagnostic information may become unavailable.

An approach to addressing this inoperability involves the use of non-volatile poly silicon fuse memory. Non-volatile poly silicon fuse memory undergoes a fusing process during the writing of information thereto that electrically opens individual fuse bits and changes the physical appearance of such bits. Written bits show a distinct discoloration that can be viewed by a microscope. This approach, however, is not without its potential challenges. For example, poly silicon fuse memory may be relatively large compared to other types of non-volatile memory. This can make poly silicon fuse memory more expensive to implement in certain applications than these other types of non-volatile memory. This relatively larger size also means that the amount of data that can be written to poly silicon fuse memory is limited per unit area compared with these other types of memory. Poly silicon fuse memory may also require the use of a microscope to detect the written bits containing the data which may not be readily available and adds to the cost of the use of such technology.

Another approach to addressing this inoperability involves the use of floating-gate avalanche-injection metal oxide semiconductor memory designs. Floating-gate avalanche-injection metal oxide semiconductor memory is relatively denser than non-volatile poly-silicon fuse memory permitting a greater amount of data to be written than with corresponding non-volatile poly silicon fuse memory. This approach, however, is also not without its potential challenges. For example, the reading of data from such floating-gate avalanche-injection metal oxide semiconductor memory requires the use of photo emission microscopy to detect the written bits containing the data which may not be readily available and adds to the cost of the use of such technology. Additionally, certain types of mechanical or electrical damage to the floating-gate avalanche-injection metal oxide semiconductor memory may make it difficult to read the data stored thereon.

Examples directed to retrieving diagnostic information concerning performance of ejection devices irrespective of the operability of communication channels of electrically-based non-volatile memory are shown in FIGS. 1-7. These example implementations illustrated in FIGS. 1-7 also attempt to address the above-described potential technical challenges associated with other possible approaches to retrieve this diagnostic information concerning performance of ejection devices in the event of such inoperability.

As used herein, the term "ejection device" represents, but is not necessarily limited to, a structure, device, mechanism or assembly that dispenses, places, ejects, deposits, or otherwise releases a composition onto or into a substrate, medium, surface, container or vessel. Examples of an ejection device include, but are not necessarily limited to, a printhead, a fuel injector, a pheromone ejector for insect-control purposes, a frosting dispenser for deserts, a three-dimensional (3D) printing device, a medicine delivery device, a fluid dispenser for laboratory or clinical use, or a paint dispenser. As used herein the term "composition" represents, but is not limited to, ink, toner, colorant, wax, dye, powder, latex, fuel, oil, paint, insecticide, medicine, frosting, food, chemical, solvent, epoxy, solution, composition, water or other compound.

As used herein, the term "processor" represents, but is not necessarily limited to, an instruction execution system such as a computer-based system, an application specific integrated circuit (ASIC), a computing device, a hardware and/or machine-readable instruction system, or any combination thereof, that can fetch or obtain the logic from a machine-readable non-transitory storage medium and execute the instructions contained thereon. "Processor" can also include any controller, state-machine, microprocessor, logic control circuitry, cloud-based service or feature, any other analogue, digital and/or mechanical implementation thereof, or any combination of the forgoing. A processor may be a component of a distributed system.

As used herein, the term "distributed system" represents, but is not necessarily limited to, multiple processors and machine-readable non-transitory storage media in different locations or systems that communicate via a network, such as the cloud. As used herein, the term "cloud" represents, but is not necessarily limited to, computing resources (hardware and/or machine readable instructions) that are delivered as a service over a network (such as the internet). As used herein, the terms "include", "includes", "including", "have", "has", "having" and variations thereof, mean the same as the terms "comprise", "comprises", and "comprising" or appropriate variations thereof.

As used herein, the term "machine-readable non-transitory storage medium" represents, but is not necessarily limited to, any medium that can contain, store, retain, or maintain programs, code, scripts, information, and/or data. A machine-readable non-transitory storage medium may include any one of many physical media such as, for example, electronic, magnetic, optical, electromagnetic, or semiconductor media. A machine-readable non-transitory storage medium may be a component of a distributed system. More specific examples of suitable machine-readable non-transitory storage media include, but are not limited to, a magnetic computer diskette such as floppy diskettes or hard drives, magnetic tape, a read-only memory (ROM), an erasable programmable read-only memory (EPROM), a flash drive or memory, a compact disc (CD), a digital video disk (DVD), or a memristor.

As used herein, the term "circuitry" represents, but is not necessarily limited to, an interconnection of elements such as a resistor, inductor, capacitor, voltage source, current source, transistor, diode, application specific integrated circuit (ASIC), processor, controller, switch, transformer, gate, timer, relay, multiplexor, connector, comparator, amplifier, filter, and/or module having these elements that allow operations to be performed alone or in combination with other elements or components. As used herein the term "memory" represents, but is not necessarily limited to, a device and/or process that allows data and information to be electrically and/or magnetically stored thereon for subsequent retrieval. Examples of a memory include, but are not necessarily limited to, a machine-readable non-transitory storage medium, random access memory (RAM), bubble memory, dynamic random access memory (DRAM), and non-volatile random access memory (NVRAM).

An example of an apparatus 10 is shown in FIG. 1. As can be seen in FIG. 1, apparatus 10 includes an ejection device 12 to dispense a composition 14. As can also be seen in FIG. 1, apparatus 10 additionally includes a diagnostic engine 16 to measure performance of ejection device 12, as generally indicated by double-headed arrow 18, and to create information regarding the measured performance of ejection device 12. Diagnostic engine 16 may represent any circuitry, processor, executable instructions, application programming interfaces (APIs), machine-readable non-transitory storage medium, or any combination thereof, that measures performance of ejection device 12. This measured performance may include information (e.g., signals, light, sound, bits, bytes and/or other data) that is received passively by diagnostic engine 16 from ejection device 12 and/or actively by diagnostic engine 16 through actuating, signaling stimulating, or otherwise interacting with ejection device 12. This measured performance information may include, but is not necessarily limited to, velocity of composition 14 as it exits ejection device 12, the condition or status of ejection device 12 (e.g., any nozzles that are clogged or otherwise not working properly), the installation date of ejection device 12, the extent of usage of ejection device 12, the length of any warranty period for ejection device 12, the last usage date of ejection device 12, the remaining period of any warranty for ejection device 12, the occurrence of any damage predetermined failure conditions for ejection device 12, the quantity of original composition 14 remaining in ejection device 12, the speed of composition 14 as it exits ejection device 12, the source or origin of composition 14 utilized by ejection device 12, the location of ejection device 12, the servicing, maintenance, repair, cleaning or work performed on ejection device 12, the history of any power, voltage, current, energy, or other stimulus applied or delivered to ejection device 12, the amount or quantity of composition 14 utilized by ejection device 12, the usage mode(s) of ejection device 12, the operating conditions (e.g., temperature, pressure, etc.) of ejection device 12, any data or other information relating to apparatus 10, or any other device, process, machine, component, substrate, medium, surface, container or vessel or other apparatus in which ejection device 12 is utilized or with which ejection device 12 interacts or changes, any other diagnostics, or any combination of the foregoing.

As can additionally be seen in FIG. 1, apparatus 10 also includes an array 20 to store the above-described information regarding the measured performance of ejection device 12 so that the information can be visually ascertained (e.g., unmagnified, with an unaided eye (except for prescription or over the counter lenses or eyeglasses), etc.) irrespective of the physical condition (e.g., damage, inoperability (partial or total), age, etc.) of ejection device 12. Examples of array 20 include, but are not limited to at least one resistor to which a current, voltage, power, magnetic pulse, magnetic wave, or other actuation is applied that oxidizes or otherwise visibly darkens; at least one fuse or anti-fuse that respectively opens or closes as a result of application of a current, voltage, power, magnetic pulse or other actuation; at least one marker that displays color(s) or changes color(s), intensity(ies), shade(s), tint(s) or tone(s), as a result of application of an actuation thereto; a capsule, vial, vessel, or other member that changes (e.g., breaks, collapses, expands, cracks, etc.) as a result of application of an actuation thereto; or any combination of the foregoing.

As can further be seen in FIG. 1, apparatus 10 also includes a recordation engine 22 coupled to diagnostic engine 16 to receive the above-described measured performance information of ejection device 12 from diagnostic engine 16, as generally indicated by arrow 24. Recordation engine 22 is also coupled to array 20 to actuate array 20 to store the information regarding the measured performance of ejection device 12 in array 20, as generally indicated by arrow 26. Recordation engine 22 may represent any circuitry, processor, executable instructions, application programming interfaces (APIs), machine-readable non-transitory storage medium, or any combination thereof, that receives the above-described measured performance information from diagnostic engine 16 regarding ejection device 12 and actuates array 20 to store the measured performance information regarding ejection device 12 in array 20.

Figure 2:
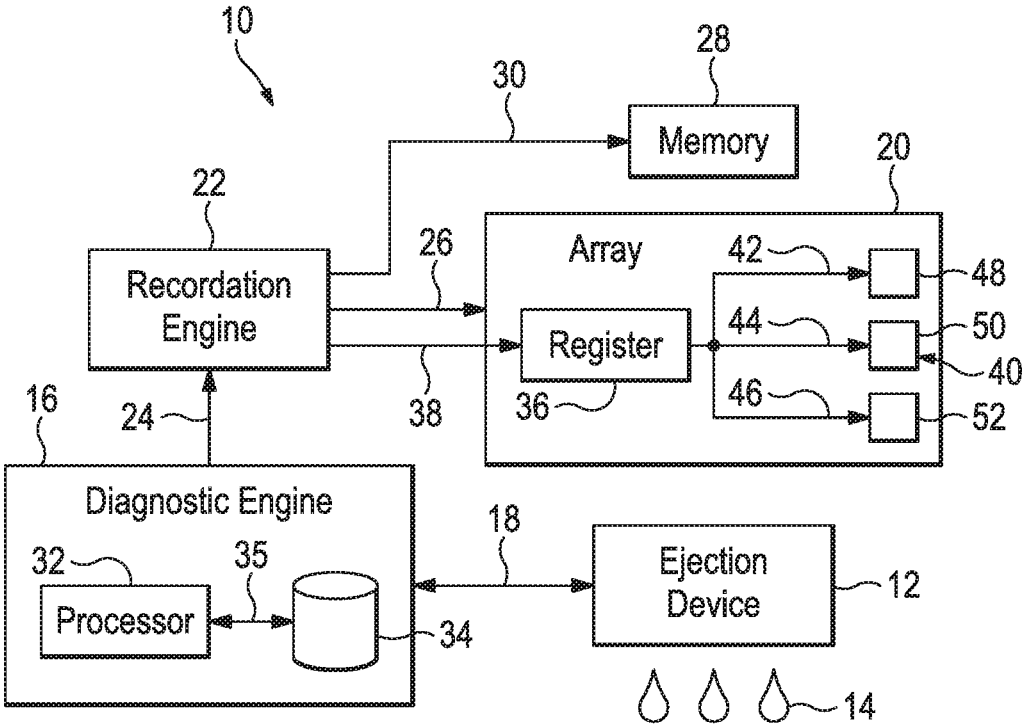
FIG. 2 is an example of additional elements of the apparatus of FIG. 1.

An example of additional possible elements of apparatus 10 is shown in FIG. 2. As can be seen in FIG. 2, apparatus 10 may include a memory 28. In such cases, recordation engine 22 is coupled to memory 28, as generally indicated by arrow 30, to electrically or magnetically record the information regarding the measured performance of ejection device 12 so that the information may be electrically or magnetically read from memory 28. This information recorded in memory 28 regarding the measured performance of ejection device 12 may be the same as the information stored in array 20. Alternatively, more or less information regarding the measured performance of ejection device 12 may be recorded in memory 28 than is stored in array 20. Also in such cases, recordation engine 22 may represent any circuitry, processor, executable instructions, application programming interfaces (APIs), machine-readable non-transitory storage medium, or any combination thereof, that electrically or magnetically records the information regarding performance of ejection device 12 so that the information may be electrically or magnetically read from memory 28.

As can also be seen in FIG. 2, diagnostic engine 16 of apparatus 10 may include a processor 32 and a machine-readable non-transitory storage medium 34 that includes instructions executable by processor 32 to measure performance of ejection device 12 and/or to create the information regarding the measured performance of ejection device 12, as generally indicated by double-headed arrow 35. As can additionally be seen in FIG. 2, array 20 of apparatus 10 may include a register 36 (e.g., a memory, cache, buffer, etc.) to electrically or magnetically store the information regarding the measured performance of ejection device 12. In such cases, recordation engine 22 is coupled to register 36 of array 20, as generally indicated by arrow 38, to electrically or magnetically record the information regarding the measured performance of ejection device 12 in register 36 of array 20. Also in such cases, recordation engine 22 may represent any circuitry, processor, executable instructions, application programming interfaces (APIs), machine-readable non-transitory storage medium, or any combination thereof, that electrically or magnetically records the information regarding performance of ejection device 12 in register 36 of array 20.

As can further be seen in FIG. 2, apparatus 10 may additionally include an interface 40 coupled to register 36 or array 20, as generally indicated by arrows 42, 44, and 46, to allow the information regarding the measured performance of ejection device 12 stored therein to be electrically or magnetically read therefrom. As can yet further be seen in FIG. 2, in this example, interface 40 includes a plurality of pads 48, 50, and 52 through which the information regarding the measured performance of ejection device 12 stored in register 36 may be accessed.

Figure 3:
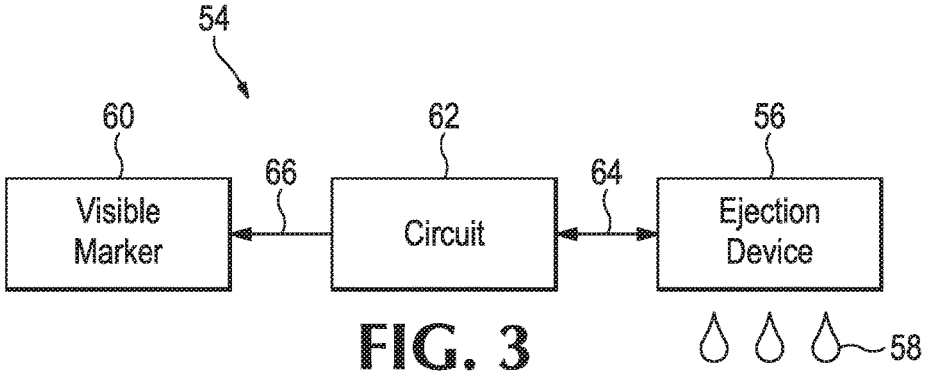
FIG. 3 is another example of an apparatus.

An example of another apparatus 54 is shown in FIG. 3. As can be seen in FIG. 3, apparatus 54 includes an ejection device 56 to dispense a composition 58. As can also be seen in FIG. 3, apparatus 54 also includes a visible marker 60 to store information regarding performance of ejection device 12. Visible marker 60 stores the information regarding performance of ejection device 12 so that this information can be visually ascertained (e.g., unmagnified, with an unaided eye (except for prescription or over the counter lenses or eyeglasses), etc.) irrespective of the physical condition (e.g., damage, inoperability (partial or total), age, etc.) of ejection device 56. Examples of visible marker 60 include, but are not limited to at least one resistor to which a current, voltage, power, magnetic pulse, magnetic wave, or other actuation is applied that oxidizes or otherwise visibly darkens; at least one fuse or anti-fuse that respectively opens or closes as a result of application of a current, voltage, power, magnetic pulse or other actuation; at least one marker that displays color(s) or changes color(s), intensity(ies), shade(s), tint(s) or tone(s), as a result of application of an actuation thereto; a capsule, vial, vessel, or other member that changes (e.g., breaks, collapses, expands, cracks, etc.) as a result of application of an actuation thereto; or any combination of the foregoing.

As can additionally be seen in FIG. 3, apparatus 54 includes a circuit 62 coupled to ejection device 56 to measure the information regarding the performance of ejection device 56, as generally indicated by double-headed arrow 64, and to visible marker 60 to record the information regarding the measured performance of ejection device 56 in visible marker 60, as generally indicated by arrow 66. This measured performance may include information signals, light, sound, bits, bytes and/or other data) that is received passively by circuit 62 from ejection device 56 and/or actively by circuit 62 through actuating, signaling stimulating, or otherwise interacting with ejection device 56. This measured performance information may include, but is not necessarily limited to, velocity of composition 58 as it exits ejection device 56, the condition or status of ejection device 56 (e.g., any nozzles that are clogged or otherwise not working properly), the installation date of ejection device 56, the extent of usage of ejection device 56, the length of any warranty period for ejection device 56, the last usage date of ejection device 56, the remaining period of any warranty for ejection device 56, the occurrence of any damage to or predetermined failure conditions for ejection device 56, the quantity of original composition 58 remaining in ejection device 56, the speed of composition 58 as it exits ejection device 56, the source or origin of composition 58 utilized by ejection device 56, the location of ejection device 56, the servicing, maintenance, repair, cleaning or work performed on ejection device 56, the history of any power, voltage, current, energy, or other stimulus applied or delivered to ejection device 56, the amount or quantity of composition 58 utilized by ejection device 56, the usage mode(s) of ejection device 56, the operating conditions (e.g., temperature, pressure, etc.) of ejection device 56, any data or other information relating to apparatus 54, or any other device, process, machine, component, substrate, medium, surface, container or vessel or other apparatus in which ejection device 56 is utilized or with which ejection device 56 interacts or changes, any other diagnostics, or any combination of the foregoing.

Figure 4:
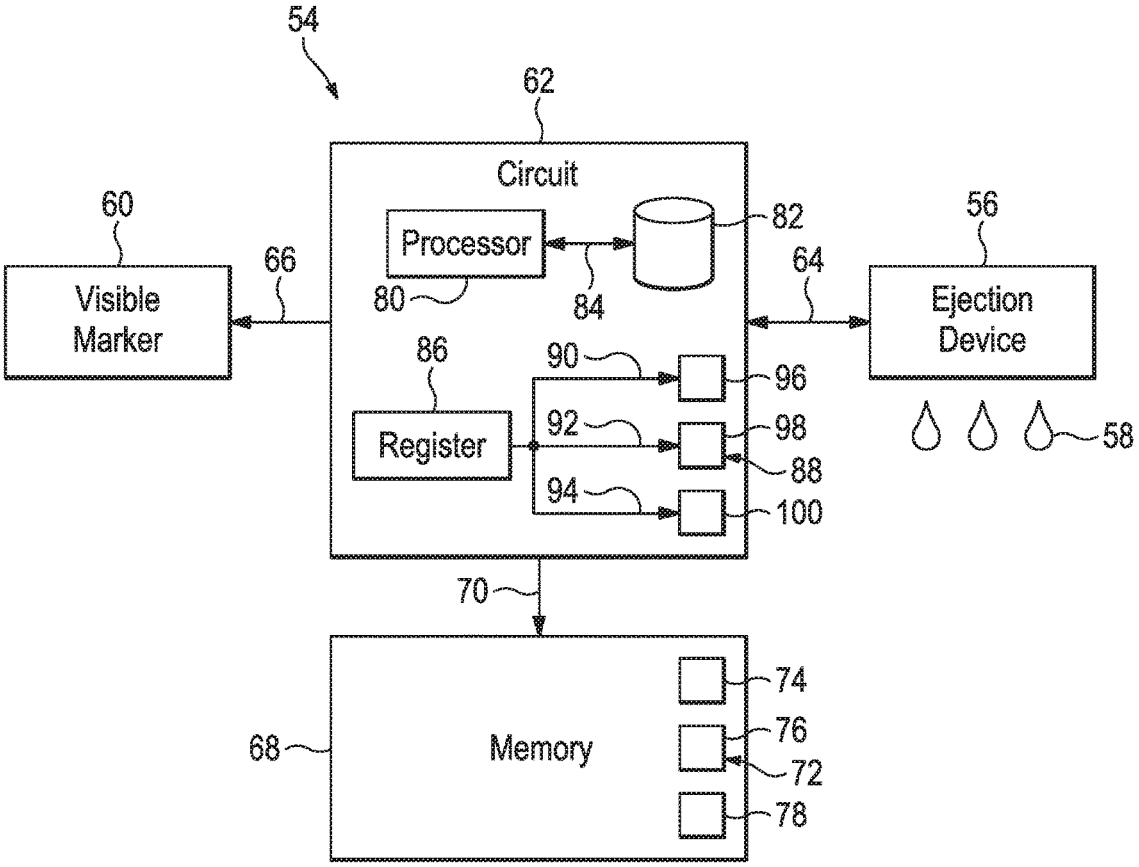
FIG. 4 is an example of additional elements of the apparatus of FIG. 3.

An example of additional possible elements of apparatus 54 is shown in FIG. 4. As can be seen in FIG. 4, apparatus 54 may include a memory 68. In such cases, circuit 62 is coupled to memory 68, as generally indicated by arrow 70, to electrically or magnetically record the information regarding the measured performance of ejection device 56. This information recorded in memory 68 regarding the measured performance of ejection device 56 may be the same as the information stored in visible marker 60. Alternatively, more or less information regarding the measured performance of ejection device 56 may be recorded in memory 68 than is stored in visible marker 60. As can further be seen in FIG. 4, apparatus 54 may additionally include an interface 72 coupled to memory 68 to allow the information regarding the measured performance of ejection device 56 stored therein to be electrically or magnetically read therefrom. As can yet further be seen in FIG. 4, in this example, interface 72 includes a plurality of pads 74, 76, and 78 through which the information regarding the measured performance of ejection device 56 stored in memory 68 may be accessed.

As can also be seen in FIG. 4, circuit 62 of apparatus 54 may include a processor 80 and a machine-readable non-transitory storage medium 82 that includes instructions executable by processor 80 to record information regarding the measured performance of ejection device 56 in visible marker 60, as generally indicated by double-headed arrow 84. As can additionally be seen in FIG. 4, circuit 62 of apparatus 54 may include a register 86 (e.g., a memory, cache, buffer, etc.) to electrically or magnetically store the information regarding the measured performance of ejection device 56. As can further be seen in FIG. 4, apparatus 54 may additionally include an interface 88 coupled to register 86, as generally indicated by arrows 90, 92, and 94, to allow the information regarding the measured performance of ejection device 56 stored therein to be electrically or magnetically read therefrom. As can yet further be seen in FIG. 4, in this example, interface 88 includes a plurality of pads 96, 98, and 100 through which the information regarding the measured performance of ejection device 56 stored in register 86 may be accessed.

Figure 5:
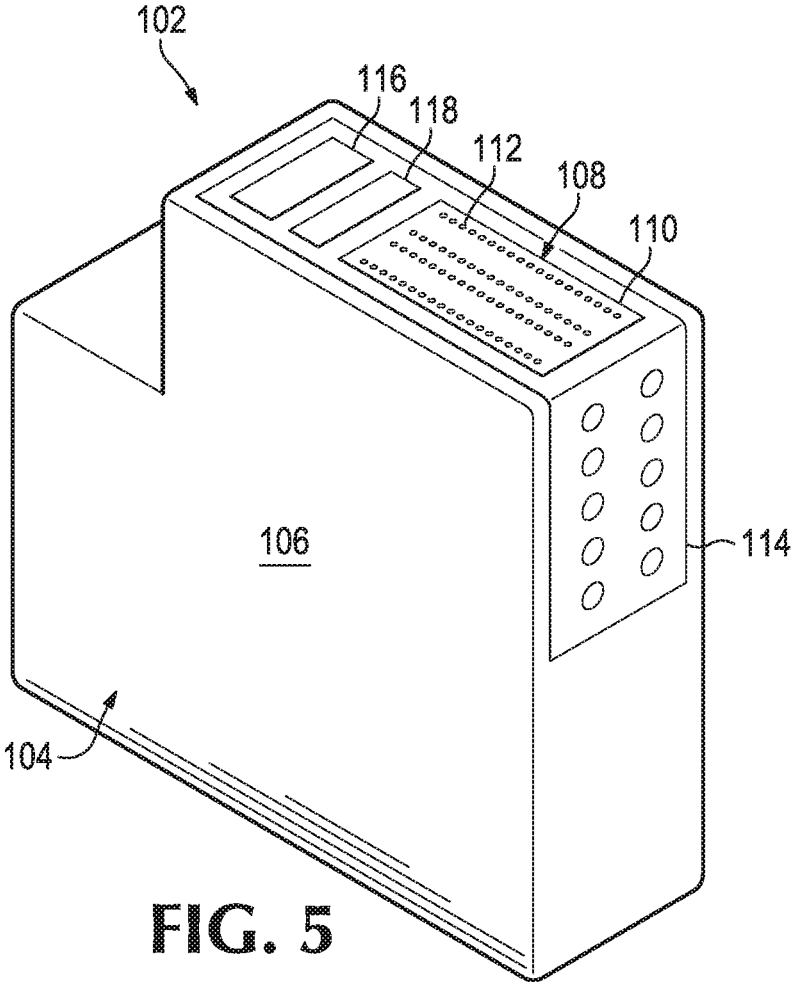
FIG. 5 is an ad additional example of an apparatus.

An additional example of an apparatus 102 is shown in FIG. 5. As can be seen in FIG. 5, apparatus 102 includes a print cartridge 104 having a housing or container 106 to store a quantity of composition (e.g., ink). Print cartridge may be an "on-axis" design that stores all of the composition in housing or container 106 or an "off-axis" design that stores a limited quantity of composition in housing or container 106 that is replenished from an external source shown). As can also be seen in FIG. 5, print cartridge 104 of apparatus 102 additionally includes an ejection device 108 to controllably emit droplets of composition onto a print medium. In this example, ejection device 108 includes a printhead 110 having a plurality of nozzles 112 through which droplets of composition are emitted or ejected.

As can additionally be seen in FIG. 5, print cartridge 104 of apparatus 102 also includes an interconnect 114 that conveys control and data signals to printhead 110 of ejection device 108 that received from a printing device (not shown) having a corresponding interconnect (also not shown) in which print cartridge 104 may be installed or otherwise disposed. Interconnect 114 may also convey control and/or data signals from printhead 110 of ejection device 108 to a printing device (not shown) via a corresponding interconnect (also not shown). As can further be seen in FIG. 5, print cartridge 104 of apparatus 102 also includes a visible module 116 that may be structurally and functionally similar to array 20 and/or visible marker 60. As can yet further be seen in FIG. 5, print cartridge 104 of apparatus 102 additionally includes a module 118 coupled to ejection device 108 and visible module 116 that may be structurally and functionally similar circuit 62 and/or diagnostic engine 16 and recordation engine 22.

Figure 6:
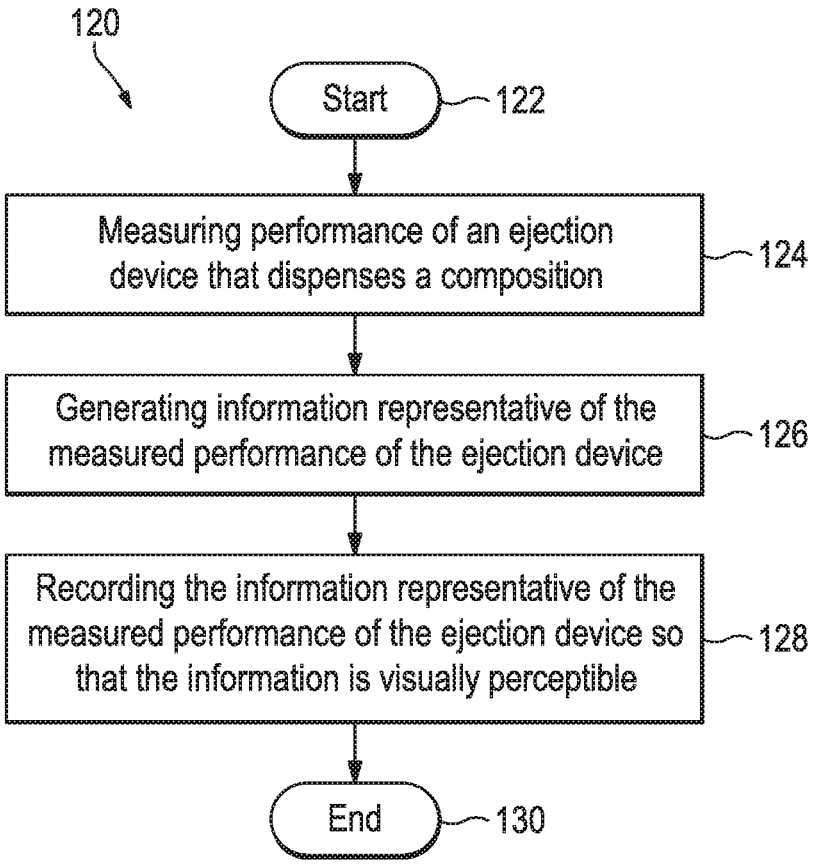
FIG. 6 is an example of a method.
Figure 7:
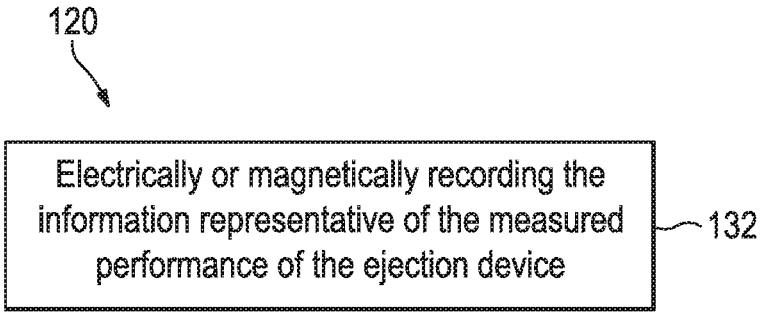
FIG. 7 is an example of an additional element of the method of FIG. 6.

An example of a method 120 is shown in FIG. 6. As can be seen in FIG. 6, method 120 starts or begins 122 by measuring, actively and/or passively, performance of an ejection device that dispenses a composition, as indicated by block 124, and generating information representative of the measured performance of the ejection device, as indicated by block 126. The generated information representative of the measured performance of the ejection device may include, but is not necessarily limited to, velocity of composition as it exits an ejection device, the condition or status of an ejection device (e.g., any nozzles that are clogged or otherwise not working properly), the installation date of an ejection device, the extent of usage of an ejection device, the length of any warranty period for an ejection device, the last usage date of an ejection device, the remaining period of any warranty for an ejection device, the occurrence of any damage to or predetermined failure conditions for an ejection device, the quantity of original composition remaining in an ejection device, the speed of composition as it exits an ejection device, the source or origin of composition utilized by an ejection device, the location of an ejection device, the servicing, maintenance, repair, cleaning or work performed on an ejection device, the history of any power, voltage, current, energy, or other stimulus applied or delivered to an ejection device, the amount or quantity of composition utilized by an ejection device, the usage mode(s) of an ejection device, the operating conditions (e.g., temperature, pressure, etc.) of an ejection device, any data or other information relating to any other device, process, machine, component, substrate, medium, surface, container, vessel or apparatus in which an ejection device is utilized or with which an ejection device interacts or changes, any other diagnostics, or any combination of the foregoing.

Method 120 continues by recording the information representative of the measured performance of the ejection device so that the information is visually perceptible (e.g., unmagnified, with an unaided eye (except for prescription or over the counter lenses or eyeglasses), etc.), as indicated by block 128. Method 120 may then end or finish 130.

An example of an additional element of method 120 is shown in FIG. 6. As can be seen in FIG. 6, method 120 may additionally include electrically or magnetically recording the information representative of the performance of the ejection device, as indicated by block 132.

Although several drawings have been described and illustrated in detail, it is to be understood that the same are intended by way of illustration and example. These examples are not intended to be exhaustive or to be limited to the precise form disclosed. Modifications, additions, and variations may well be apparent. For example, the electrically or magnetically recorded information representative of the performance of the ejection device of element 132 of method 120 may be the same as the visually perceptible information recorded by element 128 of method 120. Alternatively, more or less information representative of the performance of the ejection device may be electrically or magnetically recorded by element 132 of method 120 than the visually perceptible information recorded by element 128 method 120. As another example, in some implementations, array 20 of apparatus 10, visible marker 60 of apparatus 54, visible module 116 of apparatus 102 and/or element 128 of method 120 may store or record information in a visual format that utilizes inexpensive and readily available magnifiers to view this information rather than relatively more expensive and less available magnification technology, such as photo emission microscopy.

Additionally, reference to an element in the singular is not intended to mean one, unless explicitly so stated, but rather means at least one. Furthermore, unless specifically stated, any method elements are not limited to the sequence or order described and illustrated. Moreover, no element or component is intended to be dedicated to the public regardless of whether the element or component is explicitly recited in the following claims.

What is claimed is:

1. A print cartridge, comprising:

a housing;

an ejection device mounted to the housing, the ejection device to dispense a composition;

an array mounted to the housing and comprising a visible marker, the visible marker to store information regarding performance of the ejection device; and a circuit coupled to the ejection device, the circuit to:

measure performance of the ejection device and create information regarding the measured performance of the ejection device; and actuate the visible marker to store the information regarding the measured performance of the ejection device in the visible marker, the visual marker having a physical characteristic to be changed in response to the actuation by the circuit, the changed physical characteristic persistently storing, in the visible marker, the information regarding the measured performance and being visually perceptible from outside the housing.

2. The print cartridge of claim 1, wherein the ejection device includes a printhead.

3. The print cartridge of claim 1, further comprising a memory and wherein the circuit is coupled to the memory to one of electrically and magnetically record the information regarding the measured performance of the ejection device so that the information may be one of electrically and magnetically read from the memory.

4. The print cartridge of claim 1, wherein the circuit includes a processor and a machine-readable non-transitory storage medium including instructions executable by the processor to create the information regarding the measured performance of the ejection device.

5. The print cartridge of claim 1, wherein the array includes a register to one of electrically and magnetically store the information regarding the measured performance of the ejection device, and the circuit is coupled to the register of the array to one of electrically and magnetically record the information regarding the measured performance of the ejection device in the register of the array.

6. The print cartridge of claim 5, further comprising an interface coupled to the register of the array to allow the information stored in the register to be one of electrically and magnetically read.

7. The print cartridge of claim 1, wherein the visual marker comprises a resistor, the circuit to apply a stimulus to the resistor to change the physical characteristic of the resistor from a first visual appearance to a different second visual appearance.

8. The print cartridge of claim 1, wherein the visual marker comprises a fuse or anti-fuse, the circuit to apply a stimulus to the fuse or anti-fuse to open the fuse or close the anti-fuse to change the physical characteristic of the fuse or anti-fuse from a first visual appearance to a different second visual appearance.

9. The print cartridge of claim 1, wherein the visual marker comprises a storage element that breaks, collapses, expands, or cracks in response to a stimulus applied by the recordation engine.

10. A print cartridge comprising:

a housing;

an ejection device mounted to the housing, the ejection device to dispense a composition;

a visible marker mounted to the housing and to store information regarding performance of the ejection device; and a circuit coupled to the ejection device to measure the information regarding performance the ejection device, and to the visible marker to record the information regarding the measured performance of the ejection device in the visible marker, the visual marker having a physical characteristic to be changed in response to actuation by the circuit, the changed physical characteristic persistently storing, in the visible marker, the information regarding the measured performance and being visually perceptible from outside the housing.

11. The print cartridge of claim 10, wherein the ejection device includes a printhead.

12. The print cartridge of claim 10, further comprising a memory, and wherein the circuit is coupled to the memory to one of electrically and magnetically record the information regarding the measured performance of the ejection device.

13. The print cartridge of claim 12, further comprising an interface coupled to the memory to allow the information regarding the measured performance of the ejection device stored in the memory to be one of electrically and magnetically read.

14. The print cartridge of claim 10, wherein the circuit includes a processor and a machine-readable non-transitory storage medium including instructions executable by the processor to record information regarding the measured performance of the ejection device in the visible marker.

15. The print cartridge of claim 10, wherein the circuit includes a register to one of electrically and magnetically record the information regarding the measured performance of the ejection device.

16. The print cartridge of claim 15, further comprising an interface coupled to the register of the circuit to allow the information stored in the register to be one of electrically and magnetically read.

17. The print cartridge of claim 10, wherein the visual marker comprises a storage element that breaks, collapses, expands, or cracks in response to a stimulus applied by the circuit.

18. The print cartridge of claim 10, wherein the visual marker comprises a fuse or anti-fuse, the circuit to apply a stimulus to the fuse or anti-fuse to open the fuse or close the anti-fuse to change the physical characteristic of the fuse or anti-fuse from a first visual appearance to a different second visual appearance.

19. A method, comprising:

measuring, by a circuit mounted to a housing of a print cartridge, performance of an ejection device that dispenses a composition, the ejection device mounted to the housing of the print cartridge;

generating, by the circuit, information representative of the measured performance of the ejection device; and recording, using a visual marker mounted to the housing of the print cartridge, the information representative of the measured performance of the ejection device so that the information is visually perceptible, the visual marker having a physical characteristic to be changed in response to the recording responsive to actuation by the circuit, the changed physical characteristic persistently storing, in the visual marker, the information representative of the measured performance and being visually perceptible from outside the housing.

20. The method of claim 19, wherein the visual marker comprises one of:

a resistor, wherein the recording applies a stimulus to the resistor to change the physical characteristic of the resistor from a first visual appearance to a different second visual appearance, a fuse or anti-fuse, wherein the recording applies a stimulus to the fuse or anti-fuse to open the fuse or close the anti-fuse to change the physical characteristic of the fuse or anti-fuse from a first visual appearance to a different second visual appearance, and a storage element that breaks, collapses, expands, or cracks in response to a stimulus applied by the recording.

* * * * *